US006478676B1

(12) United States Patent
Dayan

(10) Patent No.: US 6,478,676 B1
(45) Date of Patent: Nov. 12, 2002

(54) METHOD OF PLAYING A GAME AND HARDWARE CONFIGURATION THEREFOR

(75) Inventor: Marcel Dayan, Brighton (AU)

(73) Assignee: Structured Data Systems Pty LTD, Noble Park (AU)

( * ) Notice: Subject to any disclaimer, the term of this patent is extended or adjusted under 35 U.S.C. 154(b) by 0 days.

(21) Appl. No.: 09/332,888

(22) Filed: Jun. 15, 1999

(30) Foreign Application Priority Data

Jun. 17, 1998 (AU) ..... PP 4157

(51) Int. Cl.[7] ..... G06F 19/00

(52) U.S. Cl. ..... 463/17; 463/18; 463/16; 463/27

(58) Field of Search ..... 463/17, 18

(56) References Cited

U.S. PATENT DOCUMENTS 4,836,553 A 6/1989 Suttle et al.
5,119,295 A * 6/1992 Kapur ..... 379/93.13
5,651,735 A * 7/1997 Baba ..... 463/18
5,788,237 A * 8/1998 Fults et al. ..... 273/269
5,851,011 A * 12/1998 Lott ..... 273/292
6,227,969 B1 * 5/2001 Yoseloff ..... 273/143 R
6,237,913 B1 * 5/2001 Kamille ..... 273/139
6,299,533 B1 * 10/2001 Parra et al. ..... 273/274
6,312,334 B1 * 11/2001 Yoseloff ..... 273/138.1

OTHER PUBLICATIONS

Multi–State Lottery Association web page concerning Wildcard 2.*

* cited by examiner

*Primary Examiner*—Valencia Martin-Wallace
*Assistant Examiner*—Corbett B Coburn
(74) *Attorney, Agent, or Firm*—Larson & Taylor PLC

(57) ABSTRACT

A method of playing a game including a first part and a second part. There are a number of suits and unique identifiers therefor. A player chooses at least one identifier from a suit for a first part and a game controller also chooses one identifier from a suit. The player wins the first part if the at least one identifier elected corresponds to the identifier chosen by the game controller. At the end of the first part, a second part is played by the player electing one identifier for the second part and the game controller choosing an identifier from all identifiers remaining. The player then wins relative to the game controller if the identifier elected corresponds to the identifier chosen by the game controller for the second part. The game lends itself to lottery type game playing including computer game play including game play via the Internet.

45 Claims, 7 Drawing Sheets

METHOD OF PLAYING A GAME AND HARDWARE CONFIGURATION THEREFOR

FIELD OF THE INVENTION

This invention relates to a method of playing a game such as a type of draw poker, and to a hardware configuration therefor.

DESCRIPTION OF PRIOR ART

Hitherto, there has been proposed in U.S. Pat. No. 4,836,553 a card game based on a type of poker game. This game is known as Caribbean Stud. Recently, there have been computer controlled card games where cards are displayed on a screen. A player makes bets and the game is played showing a particular card drawn by the computer. Typically, such card games are conventional poker games.

It has also been proposed recently to provide large scale played games such as Keno, Tattslotto and the like. These games often involve the drawing of the winning numbers by a Master of Ceremonies and the drawing of the numbers and the display of the numbers are usually provided on a mass entertainment medium such as television. The monies generated from game plays of the above type can be controlled by governments and the governments can secure a proportion of the winnings for public purposes such as funding of hospitals and other projects.

OBJECT AND STATEMENT OF THE INVENTION

Accordingly, in order to provide alternatives, and the generation of further funds there is a need for another game.

Therefore, according to a first broad aspect of the present invention there may be provided a method of playing a game where there are a plurality of suits, each suit having at least two different unique identifiers for each suit, the game being played in two parts by:

1. A player electing at least one identifier from a suit for a first part of the game;
2. having a game controller choosing one identifier from a suit;
3. the player winning relative to the game controller if the at least one identifier elected by that player corresponds to the identifier chosen by the game controller,
4. at the end of that first part of play playing a second part of the game by;
5. a player electing one identifier for the second part of the game;
6. having a game controller choosing an identifier from all identifiers remaining in the game after the first part has been played;
7. a player winning relative to the game controller if the identifier elected by the player for the second part of the game corresponds to the identifier chosen by the game controller for the second part of the game.

The second part of the game can be likened to a jackpot game.

Preferably a player plays by electing at least one identifier for the first part of the game and also by electing one identifier for the second part of the game, all players elected identifiers being elected prior to game play. Alternatively, a player may play by electing at least one identifier for the first part of the game, or by electing an identifier for the second part of the game.

This provides the option to play both first and second parts of the game, or only the first part of the game or only the second part of the game.

Preferably all the identifiers in each suit are grouped separately from the identifiers in the other suits and the game controller chooses an identifier from all suits during the first part of the game.

Preferably a prize is awarded for winning relative to the game controller in the first part of the game.

Preferably the prize is calculated against bets for money made by the player, and the number of correspondences to the identifiers chosen by the game controller. In one example fixed odds can be used.

Preferably the suits are based on a pack of a standard 52 card, game of cards.

Preferably the game controller has the option prior to placing bets by players to play with all the identifiers possible in each suit or only some of the identifiers in each suit.

Preferably each player elects an identifier from each suit for the first part of the game.

Preferably each player also elects an identifier for the second part of the game.

Preferably a prize is awarded for winning relative to the game controller in the second part of the game.

Preferably a number of identical games are played, and a progressive jackpot prize is provided based on all the games played if the player correctly elects all identifiers for the first part of the game and correctly elects an identifier for the second part of the game.

Preferably, the progressive jackpot prize is calculated from all the loosing players bets from all those number of games where no jackpot has been won. As each game is played, the jackpot bets made on each game are added to the previous jackpot amount from the second part of the game thereby creating a "progressive jackpot" amount. In the event a player wins all or part of a progressive jackpot, the amount won can be deducted from the jackpot amount and the subsequent jackpot bets are added thereto.

Preferably a plurality of different game types are played, and the progressive jackpot is for players of all game types.

Preferably the player makes a monetary bet with a cashier when electing at least one identifier, and is provided with a game play receipt means identifying the game and the identifier(s) elected.

Preferably the receipt means is in the form of a ticket.

Preferably the ticket also identifies the monetary bet made by the player.

Preferably, a player obtains a ticket by marking a mark sense card and supplies that card to the cashier. Desirably the card is read by a mark sensing card reader device.

Preferably the ticket is issued by a ticket selling terminal.

Preferably at the end of game play, winnings are paid out by the player presenting the ticket to a pay-out cashier.

Preferably the ticket is coded with information relating to the game to be played so that on completion of play, the code can be read and the winnings paid-out.

Preferably the coding is machine readable coding and a machine reader is used to read the code and a pay-out made from that reading by a pay-out terminal.

Preferably a Master of Ceremonies is used during game play to announce the identifier(s) chosen by the game controller to build excitement to game play.

Preferably each identifier(s) chosen by the game controller is displayed on a game monitor screen.

Preferably the game is played on a traditional Gaming Machine as a new game type. This would include playing both the first and second parts of the game on the one screen or playing the first part only and then playing the second part as the prize for winning the first part.

Preferably the game is played as an Internet game that is offered as a new game type by connecting to an Internet Casino or similar Internet Web site.

Preferably game play is software controlled in a computer device to which a game monitor screen is connected, and said game controller is functionally controlled by the software.

Preferably game play is animated on the screen from a graphics display engine forming part of the computer device.

Preferably the cashier is a software operated cashier.

Preferably player bets are placed through a bet input device connected to said computer.

In another example said bet input device is a player touch bet input device.

Preferably said bet input device is a keypad device.

Preferably said key pad device is a touch screen provided with a screen display for depicting bet options.

According to a further aspect of the present invention there is provided a computer controlled hardware interconnected configuration for playing the above game, said configuration having:

1. a computer device loaded with game software,
2. an input means through which a player can elect an identifier,
3. a monitor screen on which identifier(s) chosen by the game controller can be displayed.

Preferably said configuration also includes a ticket issuing means for issuing said game play ticket with information concerning the identifier(s) elected.

Preferably said configuration includes a machine reading means for reading the information on said ticket following game play to identify a winning players ticket.

Preferably said configuration includes a pay-out terminal for paying out winnings read by said machine reading means.

BRIEF DESCRIPTION OF THE DRAWINGS

In order that the invention can be more clearly ascertained, examples of preferred embodiments will now be described with reference to the accompanying drawings wherein.

DETAILED DESCRIPTION OF THE INVENTION

Figure 1:
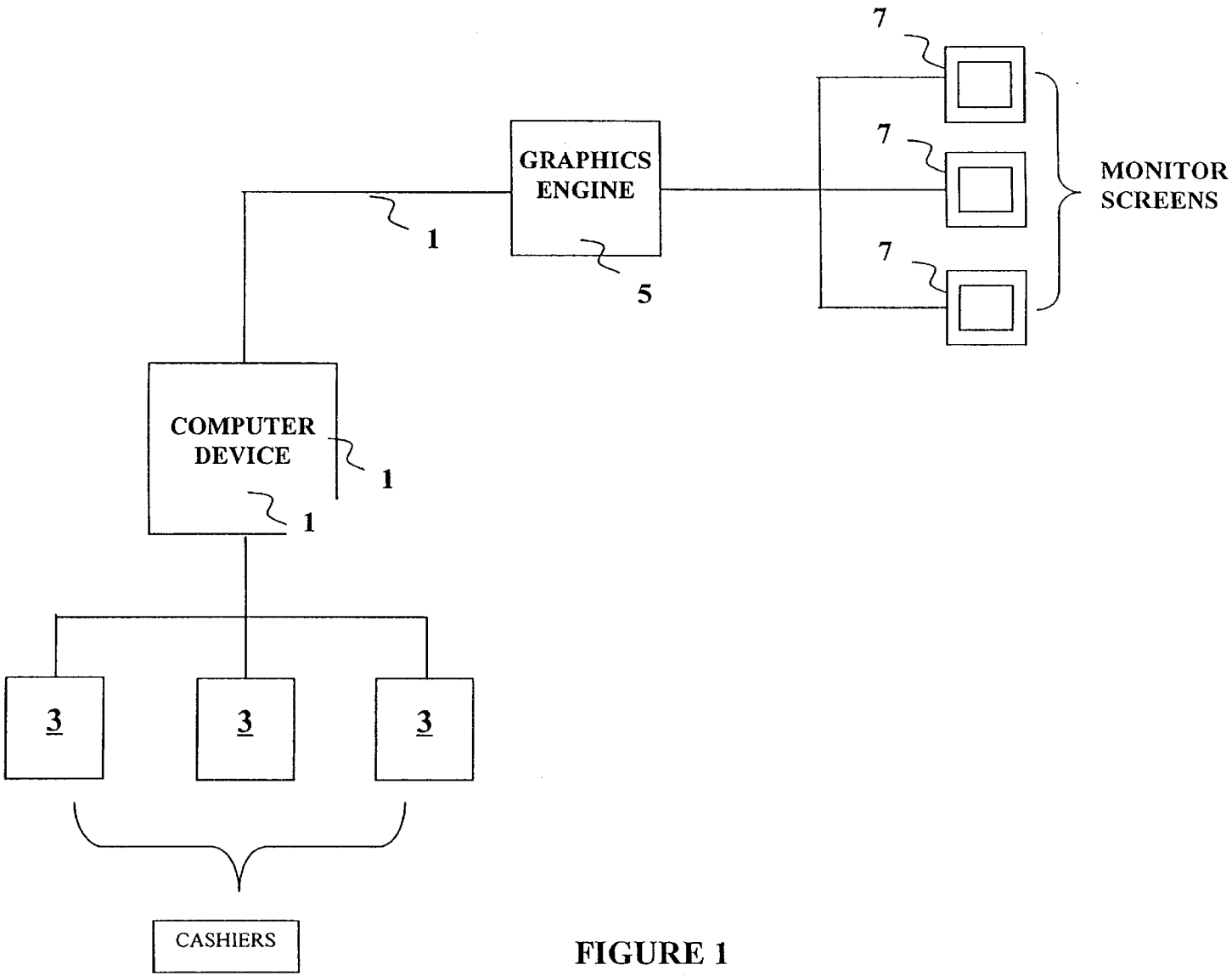
FIG. 1 is a block circuit schematic diagram of a simple configuration in one example of a preferred embodiment.

Referring firstly to FIG. 1 it can be seen that the game in this example is implemented in a configuration which includes a computer device. The game could be played manually by dealing cards from appropriate suits and these and other alternatives are not to be excluded from the broad inventive concept. The rules of the game will be described in due Course. In other examples the game may be played on a machine like a gaming machine or it may be played on the Internet.

FIG. 1 clearly shows that there is provided a computer device 1 which is interconnected with cashiers 3. The cashiers 3 are shown as a plurality with any desired number being possible. It is even possible to have a single cashier without falling outside the scope of the invention. The cashier 3 represents an input/output facility for game play where a player can participate in the game such as by placing a bet and wherein a pay-out can be made following game play as a prize for winning. The cashiers 3 provide data to the computer device 1 concerning the bets made. The computer device 1 is, in turn, connected with a graphics engine 5 which is used for displaying on one or more monitor screens 7, particular graphics relating to the game play. A suitable software program is provided within the computer device 1 to control game play and process cashier information. The graphic engine 5 is used to generate the particular image viewed on the monitor screen 7 in response to signals generated from the computer device 1. Thus, after players make bets, the computer device 1 signals the graphic engine 5 to commence a display on the monitor screen 7 relating to game play. All players then view the monitor screens to watch game play. If the players believe they have won at game play they can return to the cashiers 3 to obtain verification and collect a pay-out in that event.

The game is in two parts and is played preferably based on a pack of a standard 52-card, game of cards and in this example 28 cards are preferably used. it is possible to use all 52 cards or only some at the discretion of the game controller. The cards are arranged in suits, and the game is based on the player electing a card from one or more suits prior to game play. The computer controls game play so that when a single card is drawn from any or each suit, it is displayed on the monitor screen 7. A player is considered to obtain a win relative to the computer device 1—a game controller—if the player has elected a correct card from a particular suit. At the end of the first part of the game play a second part of the game is played where a further card is drawn from the remaining cards, such as after a shuffle of those remaining cards, and a prize is then awarded for a correct card being elected by the player corresponding to the card drawn and displayed on the monitor screen 7. In this game, a player may win by electing one or more correct cards from one or more respective suits for the first part of the game, and a different and further prize may be won independent of the initial win as a result of the draw in the second part of the game. If a player wins both at the first part of game play where the player elects all of the correct cards from all suits, and also wins at the second part of the game, then the total winnings can be the subject of a dividend win.

Accordingly it can be seen that a game is played using a plurality of suits. Each suit has at least two different unique identifiers (a separate card) in each suit. The game can be played by at least one player. The player plays by electing at least one identifier from one or more suits. The computer device 1 is in effect a game controller and game play is controlled via software within the computer device 1 so that the game controller chooses one identifier from a suit. Preferably the game controller chooses one identifier from each suit. The player then wins relative to the game controller in the first part of game play if the player's at least one identifier chosen corresponds to the identifier chosen by the game controller. Thus, players can bet on any one identifier being drawn, two cards (identifiers) being drawn, three cards (identifiers) being drawn, or all four cards (identifiers) being drawn. In the case where a 28 card pack is used the probability of a player correctly electing all four cards (identifiers) is 1 to 2,401. Similarly, the probability of electing three identifiers correctly is 1 in 343, two identifiers being elected correctly is 1 in 49, and one being elected correctly is 1 in 7. Commensurate pay-outs can be given.

A progressive jackpot prize can be drawn, as an accumulation jackpot after the playing of many games.

Typically the player pays money on placing of a bet and therefore the prize is calculated against bets for money made by all players and the number of correspondences to the identifiers chosen by the game controller for the plurality of suits. The prize is preferably based on fixed odds but in another example it may be calculated based on the total number of players and the bets made by all players for a particular game. Software can be implemented to ensure there is always a return to the game controller or the house.

The second part of the game is played by the player paying money on placing of a bet and the prize for the second part of the game is similarly calculated from fixed odds.

The following charts show betting statistics for a 52 card, card game using different numbers of identifiers:

1. CARD GAME
4 SUITS
7 IDENTIFIERS PER SUIT
24 IDENTIFIERS FOR SECOND PART OF GAME

| MARK N-SUITS | MATCH | ODDS | POSSIBLE PAY TABLE | HOUSE YIELD |
|---|---|---|---|---|
| 1 | 0 | 0.857142857143 | $0.00 | 28.57% |
| 1 | 1 | 0.142857142857 | $5.00 | |
| 2 | 0 | 0.734693877551 | $0.00 | 24.49% |
| 2 | 1 | 0.244897959184 | $1.00 | |
| 2 | 2 | 0.020408163265 | $25.00 | |
| 3 | 0 | 0.629737609329 | $0.00 | 25.95% |
| 3 | 1 | 0.314868804665 | $0.00 | |
| 3 | 2 | 0.052478134111 | $3.00 | |
| 3 | 3 | 0.002915451895 | $200.00 | |
| 4 | 0 | 0.539775093711 | $0.00 | 24.36% |
| 4 | 1 | 0.359850062474 | $0.00 | |
| 4 | 2 | 0.089962515618 | $1.00 | |
| 4 | 3 | 0.009995835069 | $25.00 | |
| 4 | 4 | 0.000416493128 | $1000.00 | |
| Probability of choosing 4 identifiers correctly in first part of game and 1 identifier correct in second part of game | | 0.000017353880 | $57,624.00 = Average Value | |

2. CARD GAME
4 SUITS
8 IDENTIFIERS PER SUIT
28 IDENTIFIERS FOR SECOND PART OF GAME

| MARK N-SUITS | MATCH- | ODDS | POSSIBLE PAY TABLE | HOUSE YIELD |
|---|---|---|---|---|
| 1 | 0 | 0.875000000000 | $0.00 | 25.00% |
| 1 | 1 | 0.125000000000 | $6.00 | |
| 2 | 0 | 0.765625000000 | $0.00 | 23.44% |
| 2 | 1 | 0.218750000000 | $1.00 | |
| 2 | 2 | 0.015625000000 | $35.00 | |
| 3 | 0 | 0.669921875000 | $0.00 | 24.80% |
| 3 | 1 | 0.297109375000 | $0.00 | |
| 3 | 2 | 0.041015625000 | $5.00 | |
| 3 | 3 | 0.001953125000 | $280.00 | |
| 4 | 0 | 0.586181640625 | $0.00 | 23.97% |
| 4 | 1 | 0.334960937500 | $0.00 | |
| 4 | 2 | 0.071777343750 | $1.00 | |
| 4 | 3 | 0.006835937500 | $15.00 | |
| 4 | 4 | 0.000244140625 | $2400.00 | |
| Probability of choosing 4 identifiers correctly in first part of game and 1 identifier correct in second part of game | | 0.000008719308 | $114,688.00 = Average Value | |

3 CARD GAME
4 SUITS
9 IDENTIFIERS PER SUIT
32 IDENTIFIERS FOR SECOND PART OF GAME

| MARK N-SUITS | MATCH- | ODDS | POSSIBLE PAY TABLE | HOUSE YIELD |
|---|---|---|---|---|
| 1 | 0 | 0.889898888889 | $0.00 | 22.22% |
| 1 | 1 | 0.111111111111 | $7.00 | |
| 2 | 0 | 0.790123456790 | $0.00 | 24.69% |
| 2 | 1 | 0.197530864198 | $1.00 | |
| 2 | 2 | 0.012345679012 | $45.00 | |
| 3 | 0 | 0.702331961591 | $0.00 | 25.38% |
| 3 | 1 | 0.263374485597 | $0.00 | |
| 3 | 2 | 0.032921810700 | $6.00 | |
| 3 | 3 | 0.001371742112 | $400.00 | |
| 4 | 0 | 0.624295076970 | $0.00 | 24.04% |
| 4 | 1 | 0.312147538485 | $0.00 | |
| 4 | 2 | 0.058527663466 | $1.00 | |
| 4 | 3 | 0.004877305289 | $50.00 | |
| 4 | 4 | 0.000152415790 | $3000.00 | |
| Probability of choosing 4 identifiers correctly in first part of game and 1 identifier correct in second part of game | | 0.000004762993 | $209,952.00 = Average Value | |

4 CARD GAME
4 SUITS
13 IDENTIFIERS PER SUIT
48 IDENTIFIERS FOR SECOND PART OF GAME

| MARK N-SUITS | MATCH- | ODDS | POSSIBLE PAY TABLE | HOUSE YIELD |
|---|---|---|---|---|
| 1 | 0 | 0.923076923077 | $0.00 | 23.08% |
| 1 | 1 | 0.076923076923 | $10.00 | |
| 2 | 0 | 0.852071005917 | $0.00 | 26.63% |
| 2 | 1 | 0.142011834320 | $1.00 | |
| 2 | 2 | 0.005917159763 | $100.00 | |
| 3 | 0 | 0.786527082385 | $0.00 | 21.71% |
| 3 | 1 | 0.196631770596 | $0.00 | |
| 3 | 2 | 0.016385980883 | $20.00 | |
| 3 | 3 | 0.000455166136 | $1000.00 | |
| 4 | 0 | 0.726024999125 | $0.00 | 24.99% |
| 4 | 1 | 0.242008333042 | $0.00 | |
| 4 | 2 | 0.030251041630 | $1.00 | |
| 4 | 3 | 0.001680613424 | $220.00 | |
| 4 | 4 | 0.000035012780 | $10000.00 | |
| Probability of choosing 4 identifiers correctly in first part of game and 1 identifier correct in second part of game | | 0.000000729433 | $1370928.00 = Average Value | |

As stated previously the game need not be played the a pack of cards or simulated cards. The game may be played with any identifiers provided they are in suits.

Figure 2:
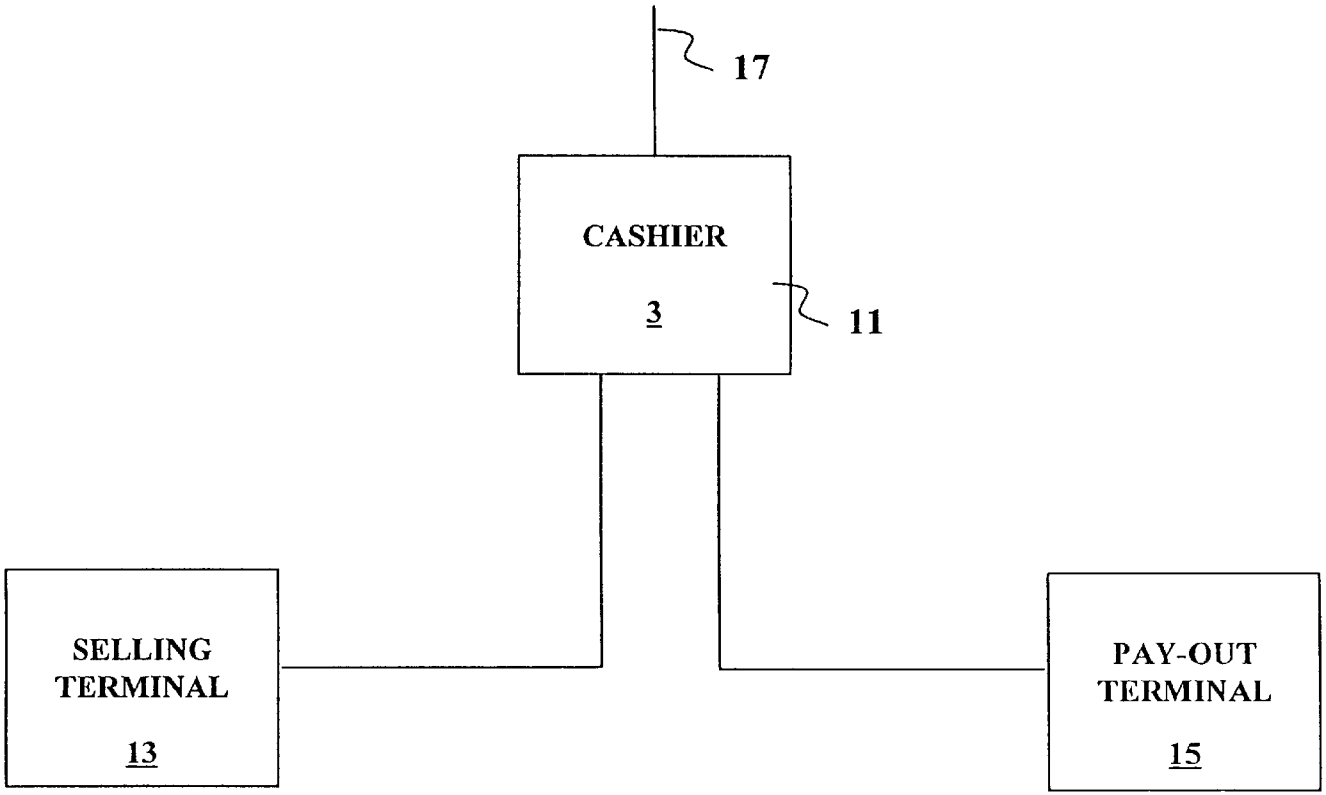
FIG. 2 is a block schematic diagram depicting an arrangement at a cashier terminal in another example.

Referring now to FIG. 2 it can be seen that the cashiers 3 operate at a cashier station 11 which includes a selling terminal 13 and a pay-out terminal 15. The actual selling terminal 13 and pay-out terminal 15 may be the same terminal. It may also be merely a person at a cashier station 11. The selling terminal 13 can however, be a separate terminal to the pay-out terminal 15. The cashier station 11 can additionally provide some miscellaneous customer functions such as operator sign-on, operator signoff, terminal balances and the like. The cashier station 11 may be a manned betting terminal, a self-service betting terminal, or a mobile terminal or the like. The basic operation of each terminal 11 is independent of the terminal type. The terminal 11 is a programmed device that communicates with the computer device 1 via a communication line 17 or by a bus connection in a gaming machine or via the Internet in an Internet implementation. The actual program for the terminal 11 is permanently stored in ROM at the terminal but in a gaming machine or in an Intemet implementation the program can be appropriately provided. However, it could be down-line loaded to terminal memory from the computer device 1. Variable data such as currency symbols, and unit cost for playing may be down-loaded into the terminal 11 from the computer device 1 each time the terminal 11 starts up.

The terminal 11 software drives the operator interfaces, gathers operator inputs, sends data representative thereof to the computer device 1 for validation and processing. It also permits receiving the computer device 1 reply and displays the result, and permits a receipt means to be provided. In one preferred example this receipt means can be a ticket which is automatically printed, or it can be a ticket which is manually prepared. In another example the receipt means may be displayed on a screen if the game is played on a gaming machine or on the Internet. In another possibility it may be stored on some convenient medium such as a memory means and could include a smartcard. The receipt means is the player's receipt for game play. While the terminal 11 carries out some validation of inputs, all transactions which update the system are sent to the computer device 1 where they are fully validated independent of any terminal validation, and processed and recorded before a terminal reply is generated from the computer device 1. Terminal 11 reacts to the computer device 1 reply and displays an error if the transaction is in error, or displays the bet and prints the ticket if the transaction is valid. The terminal is therefore preferably totally subservient to the computer device 1 and can only generate output based on information received from the computer device 1. Desirability emphasis is placed on accountability and every transaction needs to be received and recorded in the computer device 1 before a validation reply is sent back to the terminal 11 before it is seen either by an operator of the terminal or the game player.

The monitor screen 7 display an animation of the draw or selection of the identifiers—cards—and the monitor screen 7 permits this display to be viewed by the player(s) and also permits audible sounds to be presented, as generated from the graphics engine 5.

The graphics engine 5 generates the graphic displays and sounds for the game including the draw animation as well as a subsequent display of the result, all in response to instructions received from the computer device 1. The graphics engine 5 is programmed to receive signals from a communications line 19 connected with the computer device 1. The graphics engine 5 also includes a storage medium which contains the necessary programs and databases needed to generate full multi-media animation and other graphics displays. This can include a number of different scenarios that make the draw sequence different.

Each complete game sequence consists of a number of stages to sustain player interest and desirably includes results analysis of previous games played, most common and least common identifiers chosen, and jackpot information. It may also include various forms of promotions and advertising. The order of these stages is typically fixed and the duration of each stage is set by instruction from the computer device 1. Some stages may cycle automatically without any input from the computer device 1 while other stages are implemented in response to game play instruction from the computer device 1.

In an Internet implementation the screen is part of a PC configuration and the graphics engine program resides in the PC.

At the beginning of each new game, information pertaining to the next game is sent to the graphics engine 5 from the computer device 1 and superimposed on the graphics held by the graphics engine 5. When the computer device 1 is ready to commence draw for game play, it sends the graphic engine 5 a message which contains the scenario to be used and the winning identifiers-cards (as determined by a random number generator within the computer device 1 or alternatively by a manual draw). The graphics engine 5 then animates the draw using full multi-media representation to produce winning identifiers-cards-with the requested scenario determined from the computer device 1. Once the draw has been fully animated, and results displayed, the graphic engine 5 informs the computer device 1 so that pay-out can then commence.

In this case, the graphics engine 5 is subservient to the computer device 1 and carries out displays and draw animations according to instructions from the computer device 1.

The computer device 1 is under control of a suitable software program and holds the system parameters, system databases, and other system details and controls necessary for operation of the total system. All of the components in the system are subservient to the computer device 1.

The computer device 1 contains the necessary programs to run the system and the control files needed to control the system and the databases that hold the system data. As stated above, the results of game play for the draws can be generated by a random number generator or manually by a human operator. In the case of draw by a human operator input. can be provided to the computer device 1 to signal the particular identifiers drawn. In this way, the information can then be displayed on the monitor screen 7. Typically if a manual draw is implemented then information concerning each drawn identifier can be manually input to the computer device 1.

In the case where a random number generator is utilized then this will be a separate procedure operating within the computer device 1 so that the random numbers generated are based on an algorithm recommended by gaming consultants. The winning identifiers—cards—are then generated from the random numbers selected. Alternatively a separate random number generator can be provided which inputs into the computer device 1.

In a variation of the above system, and assuming that the game is played in a regional location such as a large city, a Master of Ceremonies may announce the game on local television or radio. The actual draw may be televised so that players can individually see the identifiers drawn. The draw may be manual or may be under control of the computer device 1 and the graphics engine 5 or by some other means. The Master of Ceremonies can be used in a manner similar to Keno and Tattslotto-type television games, and provide enhanced excitement to players. Identifiers manually drawn can be suitably inputted to cashiers for pay-outs to winning players.

Figure 3:
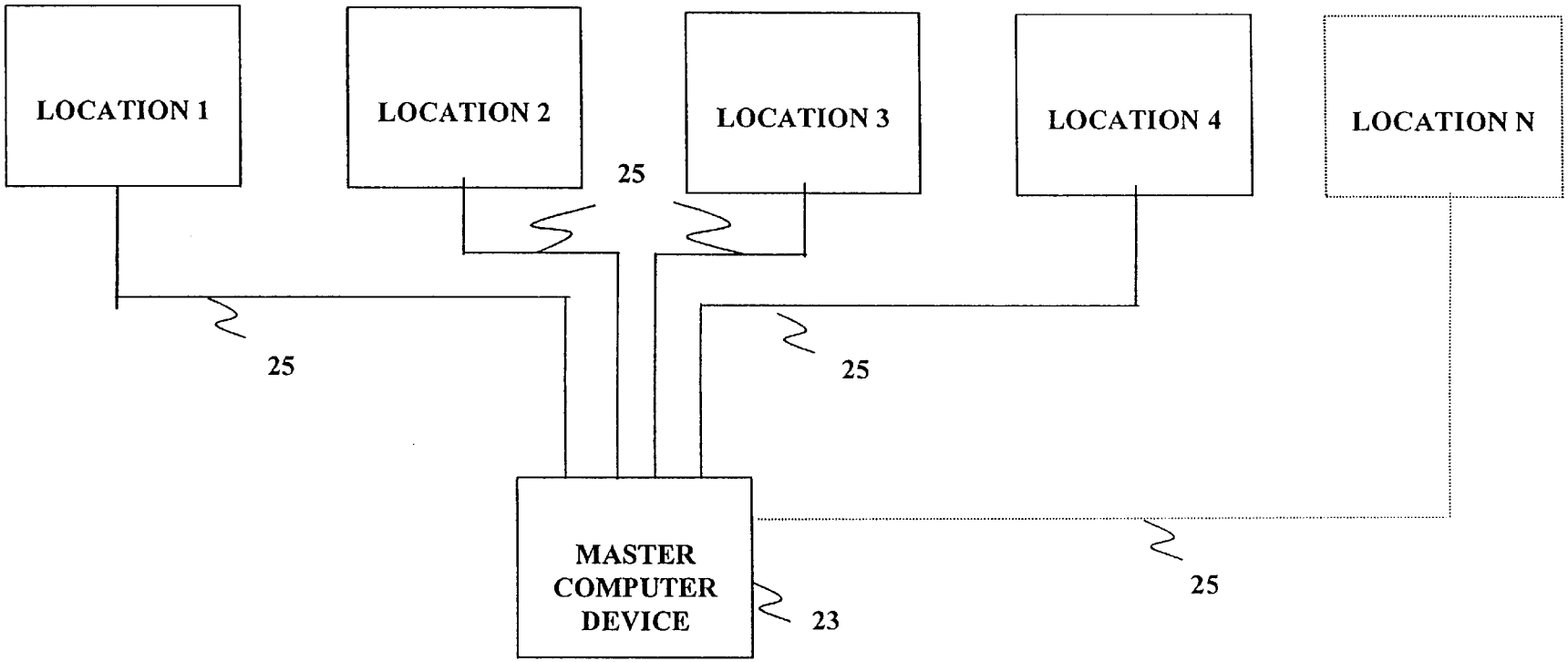
FIG. 3 is a block circuit diagram depicting a number of game playing locations interconnected with a master computer device in another example.

FIG. 3 shows an environment where there are a number of discrete locations 1 to N of cashiers, graphics engines, and monitor, screens. In this configuration all locations are controlled from a master computer device 23. Each of the locations are connected via communication lines 25. Controlling software can be used to control game play concurrently at all locations.

Figure 4:
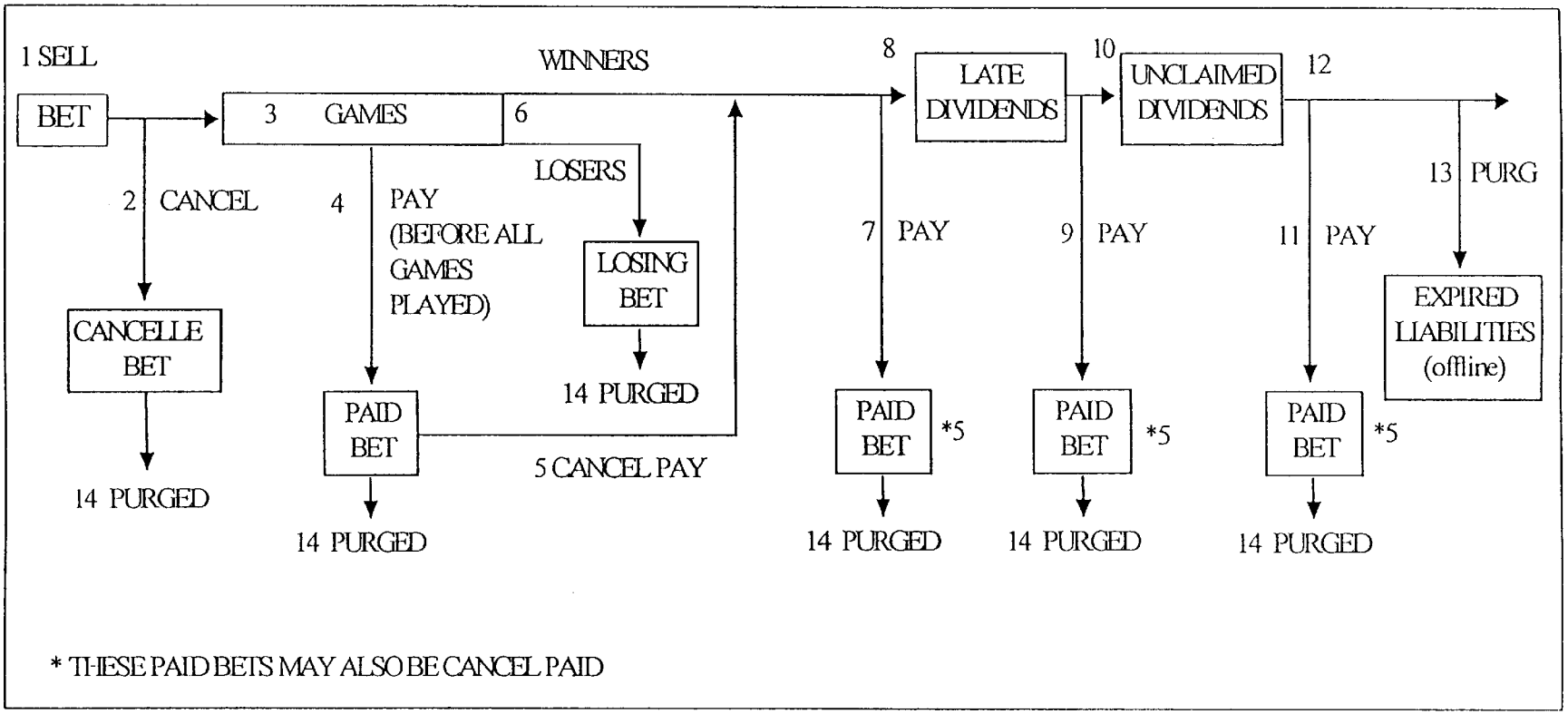
FIG. 4 is a functional flow diagram showing stages of game play and betting in an example.

FIG. 4 is a diagram which shows the stages a bet which a game play can go through and are self-explanatory. It has the following steps.

1. The bet details are validated, and if valid, the bet value and a unique serial number are sent back to the terminal for printing of a ticket. The bet is then considered to be sold.
2. It may be cancelled before it can play any games.
3. Otherwise it starts to play its games.
4. A multi-game ticket may be paid before all its games are played.
5. A paid ticket may be 'cancel paid'. It DOES NOT PLAY ANY MORE GAMES and is treated like an unpaid winner. (It may be paid later).
6. Otherwise bets play all the games for which they were bought. Bets receiving dividends are winners; the remaining bets are losers.
7. Winning bets may be paid.
8. Winning bets that remain unpaid after the period of the last game are called late dividends. Late dividends can be paid.
9. After a period of time (set by parameters maintenance), unpaid late dividends become unclaimed dividends and the money resumed by the Government or Game Operator (depending on legislation in the jurisdiction).
10. Unclaimed dividends may be paid (and it is possible for this paid winning bet to be 'cancel paid' and paid again later). If an unclaimed winner is paid, the value is netted from that period's unclaimed dividend value.
11. Depending on the parameters that have been selected for the system, the unclaimed winner may continue in the system 'forever' (or until paid).
12. Else the unclaimed dividend will be purged (and reported) after the end of the period requested.
13. Cancelled bets, losing bets, paid bets are all purged from the system at the intervals that have been specified.

For completeness, cancel pays (STEP 5) have been shown but cancel pays should be extremely rare, probably only occurring when a terminal operator has insufficient funds to pay a large winning bet.

Figure 5:
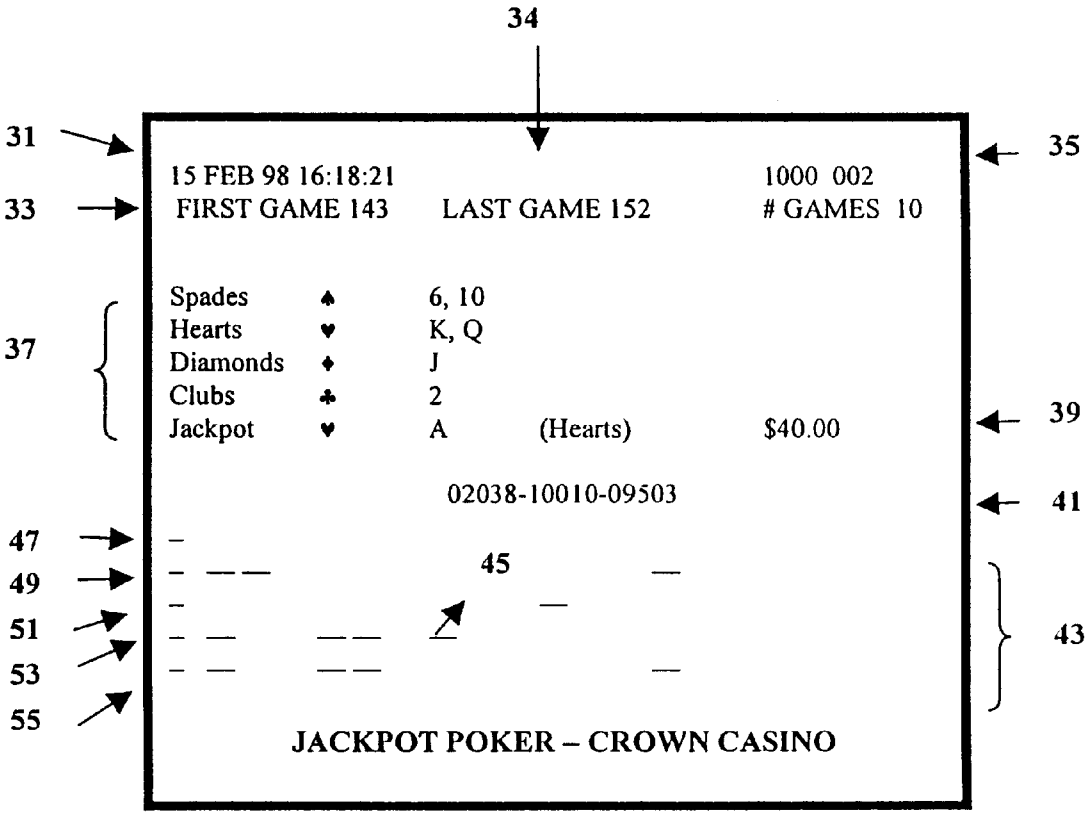
FIG. 5 is a representation of a ticket issued prior to game play in an example.

FIG. 5 shows a typical receipt means in the form of a ticket which is issued to a person playing a game following the placing of a bet. It can be seen that it includes the date at the top region 31, the first game to be played at region 33, the last game to be played at region 34, the number and location of the terminal for issue of a ticket at 35, and the particular identifier(s) selected for each suit at region 37. It is to be noted that in the particular ticket shown, the player has selected two identifiers from two suits and single identifiers from two other suits. Thus, a player can elect to choose one or more identifiers in each suit for the first part of the game and one or more identifiers for the second part of the game. The monetary value paid for the ticket is shown in area 39. Area 41 shows the serial number of the ticket. Area 43 shows markings representative of the serial number of the ticket which can be read from the ticket by a machine reader device to facilitate processing of pay-outs. This provides a pointer that allows the software to locate the bet in memory of the computer. The exact arrangement of the code shown is immaterial and is merely representative of a typical arrangement. If multiple games are played this is represented by the first game number and the last game number in areas 33 and 34.

In the ticket shown in FIG. 5 there are four separate bets to cover all four suits in the first part of the game, and the second part of the game. These are as follows:

Bet 1 for first part of game
6 of Spades
King of Hearts
Jack of Diamonds
2 of Clubs for second part of game
Ace of Hearts.

Bet 2 for first part of game
10 of Spades
King of Hearts
Jack of Diamonds
2 of Clubs for second part of game
Ace of Hearts.

Bet 3 for first part of game
6 of Spades
Queen of Hearts
Jack of Diamonds
2 of Clubs for second part of game
Ace of Hearts.
Bet 4 for first part of game
10 of Spades
Queen of Hearts
Jack of Diamonds
2 of Clubs
for second part of game
Ace of Hearts.

The tickets show ten games by the fact the first game is shown as 143 and the last game is shown as 152. For a $1.00 per unit bet the ticket shows for the four bets, for ten games a total ticket bet of $40.00.

Figure 6:
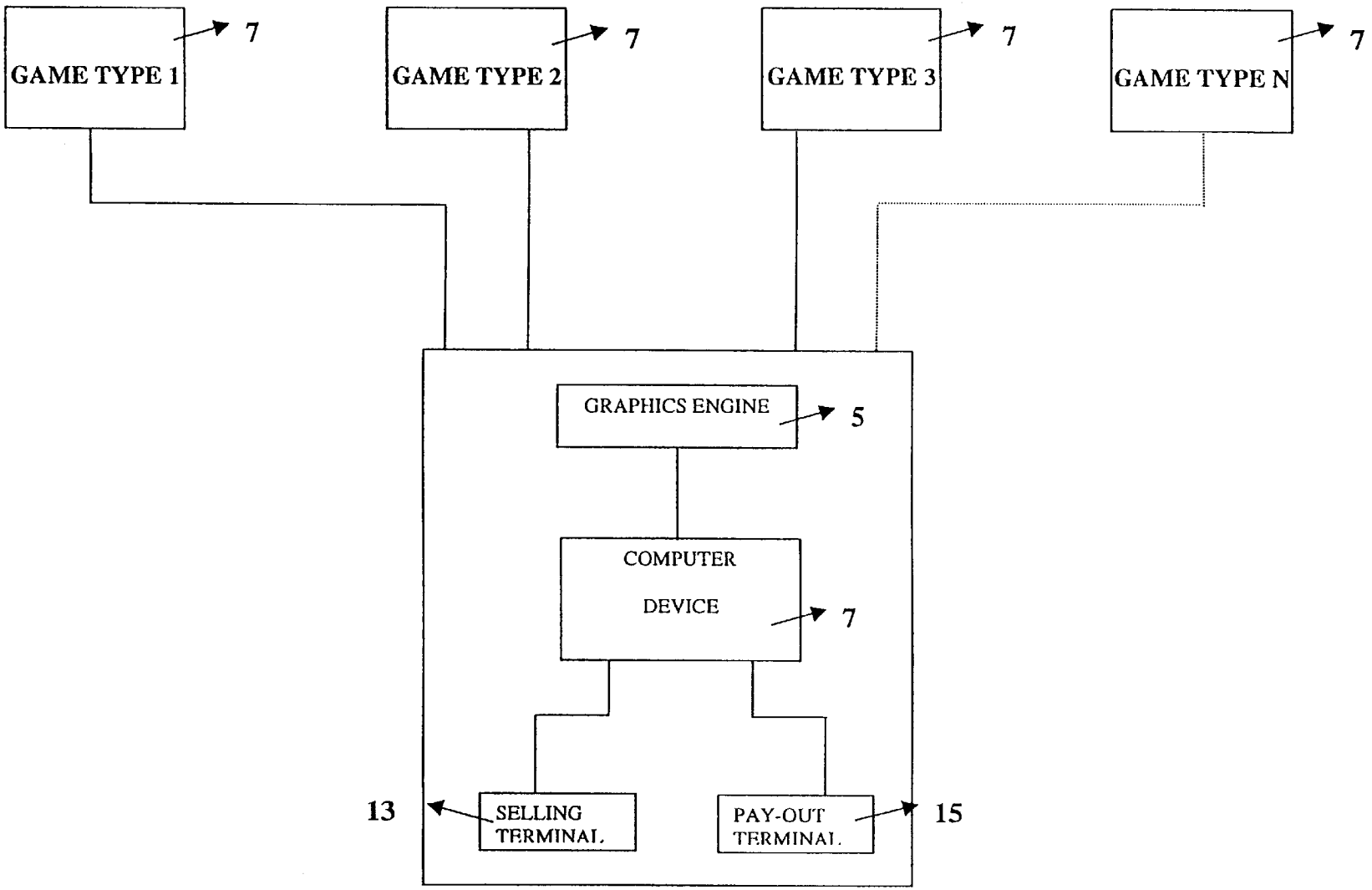
FIG. 6 is a block circuit schematic diagram representing a configuration where a plurality of different game types are played in the configuration in another example.

Referring now to FIG. 6 it can be seen that there is an arrangement whereby a plurality of different types of games can be played through the configuration shown in FIGS. 1 and 2. In this case there may be different monitor screens 7 for each game or alternatively all games may be played on a single monitor screen 7. Software will prevent different game types clashing during play of another game type. In this scenario, the graphics engine 5 will contain all the necessary software for each of the respective game types.

The monitor screens 7 and associated audio speakers or a Master of Ceremonies providing draw results through a television station or radio station or the like can announce a pre-draw game build-up. In this case the Master of Ceremonies may announce as follows "Ladies and Gentlemen, this is your last chance to win "x" dollars on the next game which will be drawn in 20 seconds time."

There can be music and fanfare and other displays to build player excitement. The Master of Ceremonies will then conduct the game play. This may involve separating the number of cards to be played from a pack of cards into each of its suits on the television screen or radio. Each suit may be shuffled.

During game play a card is then drawn from each suit with a voice-over announcing the card drawn. After all the identifiers—cards—are drawn from the respective suits, the remaining cards can be joined together and shuffled for the second part of the game. Similar fanfare and announcements can be made to attract players to the draw. A voice-over announcing the identifier—card—drawn can then be made.

The results of all 5 identifiers—cards—can then be displayed. The monitor screens 7 can then, if desired, slowly display back over the last games, such as the last 16 through 20 game plays and show the most popular and least popular identifiers drawn.

In a variation, a progressive jackpot prize can be drawn as an accumulation jackpot after the playing of many games, as discussed previously. This could be based on all of the identifiers played in the games or only those remaining and not drawn from the drawing of the identifiers from the suits during the first part of game play prior to the second part of play. Alternatively, it could be based on only those identifiers drawn from the second part of play during each game.

In a further variation a plurality of different game types can be played wherein the game suits and identifiers are played, and wherein the progressive jackpot is for players of all game types and where a bet by a player triggers a progressive jackpot value from all bets made by all players for all games. The value of the progressive jackpot can be set in any convenient way such as manually or electronically and can therefore be a mystery progressive jackpot, particularly if it is randomly chosen.

Figure 7:
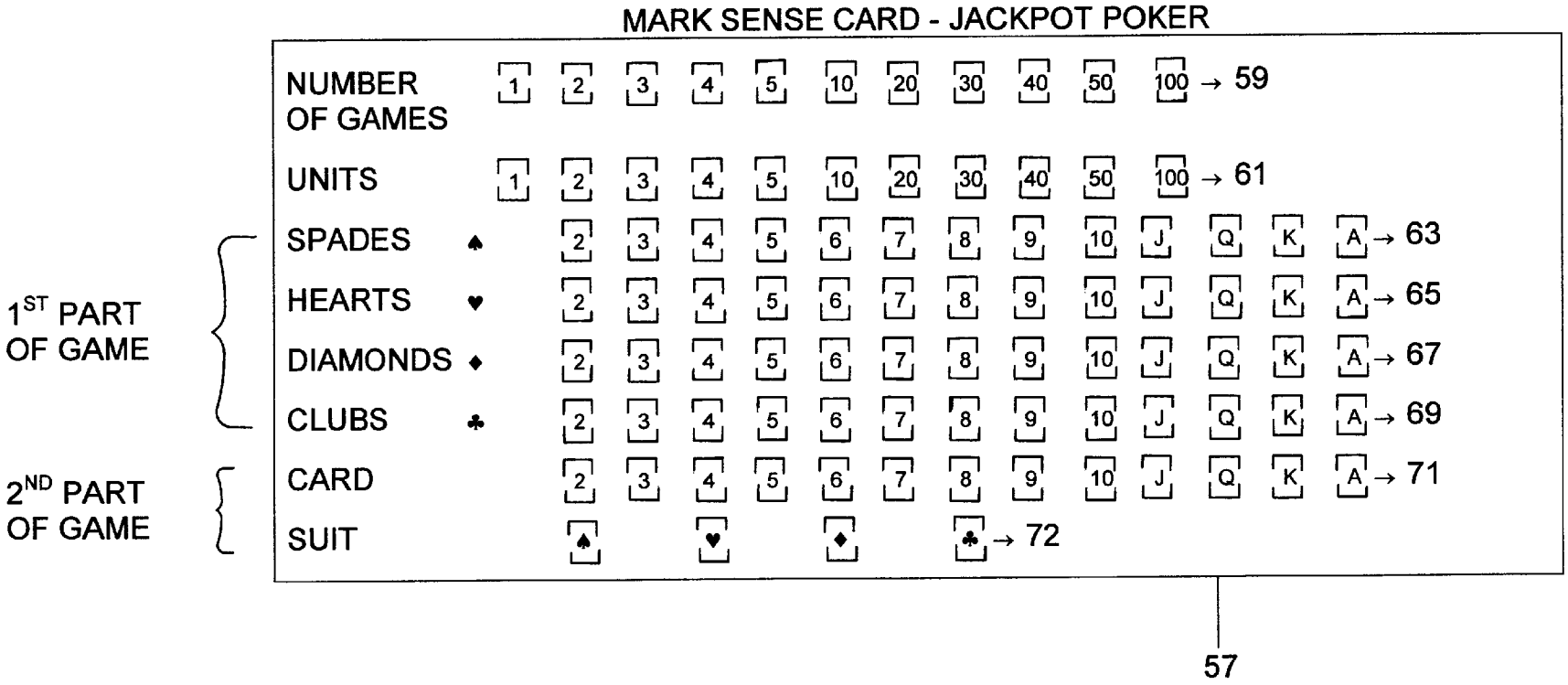
FIG. 7 shows a mark sense card which can be used by a player to indicate bet(s) in a further example.

In a further variation a mark sense card 57 can be used. Such a card is exemplified in FIG. 7 and has unique areas provided to cater for:

(a) Number of games to be played
(b) Units to be bet
(c) Spades
(d) Hearts
(e) Diamonds
(f) Clubs
(g) Card for second part of game and suit.

These areas are respectively shown as areas 59, 61, 63, 65, 67,69, 71 and 72. The card can be marked by a player prior to game play by scoring a line or other marking through the appropriate area(s). The marked card 57 can then be presented to a cashier and the bet made. The cashier may manually check the markings or may input the card 57 to a mark sense card reader where the chosen identifiers, games to be played, and units bet can be read and an appropriate ticket issued. If desired, the player could input the marked card 57 directly into a mark sensor reader at the cashier.

Modifications may be made to the invention as would be apparent to a person skilled in the gaming and entertainment arts. These and other modifications may be made without departing from the ambit of the invention the nature of which is to be determined from the foregoing description.

What is claimed is:

1. A method of playing a game where there are a plurality of suits each suit having at least two different unique identifiers thereof, the game being played in to parts comprising the steps of:

(a) playing a first part of the game, including the steps of
a player electing at least one identifier from a suit for a first part of the game;
having a game controller choosing one identifier from a suit for the first part of the game; and
the player winning relative to the game controller for the first part of the game if the at least one identifier from the suit elected by that player for the first part of the game corresponds to the identifier from the suit chosen by the game controller for the first part of the game; and (b) at the end of the first part of the game, playing a second part of the game, including the steps of
a player electing one identifier from a suit for the second part of the game;
having the game controller choosing an identifier from a suit for the second part of the game from all identifiers of all suits remaining in the game after the first part has been played; and
a player winning relative to the game controller for the second part of the game if the identifier from the suit elected by the player for the second part of the game corresponds to the identifier from the suit chosen by the game controller for the second part of the game.

2. A method as claimed in claim 1 wherein said second part of the game is a jackpot game.

3. A method as claimed in claim 1 wherein a player plays by electing at least one identifier from a suit for the first part of the game and also by electing one identifier from a suit for the second part of the game prior to the game controller choosing one identifier from a suit for the first part of the game.

4. A method as claimed in claim 1 wherein a second player plays by electing either at least one identifier from a suit for the first part of the game only, or by electing an identifier from a suit for the second part of the game only.

5. A method as claimed in claim 1 wherein all the identifiers in each suit are grouped separately from the identifiers in the other suits, and wherein the game controller chooses an identifier from all suits during the first part of the game.

6. A method as claimed in claim 1 wherein a prize is awarded to the player for winning relative to the game controller in the first part of the game.

7. A method as claimed in claim 6 wherein the prize is calculated against bets for money made by the player, and a number of correspondences of the identifiers from the suits chosen by the player relative to the identifiers from the suits chosen by the game controller.

8. A method as claimed in claim 7 wherein fixed odds are used.

9. A method as claimed in claim 7 wherein the game is set prior to a placing of bets by players to play with all the identifiers possible in each suit or only some of the identifiers in each suit.

10. A method as claimed in claim 7 wherein a number of identical games are played, wherein there are a plurality of players, and wherein a progressive jackpot prize is provided based on a number of all the games played if the player correctly elects all identifiers from the suits for the first part of the game and correctly elects an identifier from the suit for the second part of the game.

11. A method as claimed in claim 10 wherein the progressive jackpot prize is calculated from a number of all non-winning players' bets made in the number of identical games played where no jackpot prize has been won.

12. A method as claimed in claim 11 wherein as each game is played, each jackpot bet made on each game is added to the previous jackpot prize amount from the second part of the game thereby creating a "progressive jackpot" prize amount.

13. A method as claimed in claim 11 wherein a player wins all or part of a progressive jackpot, wherein the amount won is deducted from the jackpot amount and wherein the subsequent jackpot bets are added thereto.

14. A method as claimed in claim 11 wherein a plurality of different game types are played, and wherein the progressive jackpot is for players of all game types.

15. A method as claimed in claim 1 wherein the suits are based on a pack of a standard 52 card, game of cards.

16. A method as claimed in claim 1 wherein there are a plurality of players and wherein each player elects an identifier from each suit for the first part of the game.

17. A method as claimed in claim 16 wherein each player also elects an identifier from a suit for the second part of the game.

18. A method as claimed in claim 1 wherein a prize is awarded to the player for winning relative to the game controller in the second part of the game.

19. A method as claimed in claim 1 wherein the player makes a monetary bet with a cashier when electing at least one identifier from a suit, and wherein the player is provided with a game play receipt means identifying the game and the identifier(s) from the suit(s) elected.

20. A method as claimed in claim 19 wherein the receipt means is a ticket.

21. A method as claimed in claim 20 wherein the ticket also identifies the monetary bet made by the player.

22. A method as claimed in claim 19 wherein at the end of game play, winnings are paid out to the player presenting a winning game play receipt means to a pay-out cashier.

23. A method as claimed in claim 22 wherein the game play receipt means is coded with information relating to the game to be played so that on completion of play, the code can be read and the winnings paid-out.

24. A method as claimed in claim 23 wherein the coding is machine readable coding, wherein a machine reader is used to read the code, and wherein a pay-out is made from that reading by a pay-out terminal.

25. A method as claimed in claim 19 wherein player bets are placed through a bet input device connected to a computer controlling game play.

26. A method as claimed in claim 25 wherein said bet input device is a player touch bet input device.

27. A method as claimed in claim 25 wherein said bet input device is a keypad device.

28. A method as claimed in claim 27 wherein said key pad device is a touch screen provided with a screen display for depicting bet options.

29. A method as claimed in claim 1 wherein the player obtains a game play ticket by marking a mark sense card and wherein the player supplies that sense card to a cashier in order to be able to take part in the game.

30. A method as claimed in claim 29 wherein the sense card is read by a mark sensing card reader device so player markings on the sense care are captured for electronic processing.

31. A method as claimed in claim 29 wherein the ticket is issued by a ticket selling terminal.

32. A method as claimed in claim 29 wherein the cashier is a software operated cashier.

33. A method as claimed in claim 1 wherein the identifier(s) from the suit(s) chosen by the game controller are announced to build excitement to game play.

34. A method as claimed in claim 33 wherein a master of ceremonies is used to make the announcement.

35. A method as claimed in claim 1 wherein each identifier(s) from the suit(s) chosen by the game controller is displayed on a game monitor screen.

36. A method as claimed in claim 35 wherein the first part and the second part are played on the screen.

37. A method as claimed in claim 1 wherein a player plays the first part, and, wherein as a prize for winning at the first part the player is then permitted to play the second part.

38. A method as claimed in claim 1 wherein the game is Internet accessible, and wherein a player plays the game by connecting with an Internet web site via a terminal means which permits Internet use.

39. A method as claimed in claim 1 wherein game play is software controlled in a computer device to which a game monitor screen is connected, and wherein said game controller is functionally controlled by the software in a computer.

40. A method as claimed in claim 39 wherein game play is animated on the screen from a graphics display engine forming part of the computer device.

41. A computer controlled hardware interconnected configuration for playing the game of claim 1, said configuration having:

1. a computer device loaded with game software,
2. an input means through which a player can elect an identifier from a suit,
3. a monitor screen on which identifier(s) from the suit(s) chosen by the game controller can be displayed.

42. A configuration as claimed in claim 41 including a ticket issuing means for issuing a game play ticket with information concerning the identifier(s) from the suit(s) elected.

43. A configuration as claimed in claim 42 including a machine reading means for reading the information on said ticket following game play to identify a winning player's ticket.

44. A configuration as claimed in claim 43 including a pay-out terminal for paying out winnings read by said machine reading means.

45. A configuration as claimed in claim 41 loaded at an Internet web site and wherein the Internet web site is accessible by a player through a player operable terminal means.

* * * * *